United States Patent [19]

Noritake et al.

[11] 3,940,240

[45] Feb. 24, 1976

[54] BAKING METHOD AND KILN FOR TILE

[75] Inventors: Muneo Noritake; Masaharu Takeuchi, both of Aichi, Japan

[73] Assignee: INA Seito Co., Ltd., Tokoname, Aichi, Japan

[22] Filed: July 11, 1974

[21] Appl. No.: 487,804

[52] U.S. Cl. ..... 432/122; 432/137; 432/140

[51] Int. Cl.[2] ..... F27B 9/14; F27B 9/26

[58] Field of Search ..... 432/122, 137, 140, 153

[56] References Cited

UNITED STATES PATENTS

| | | | |
|---|---|---|---|
| 1,385,365 | 7/1921 | Dreyfoos | 432/122 |
| 1,603,760 | 10/1926 | Furkert | 432/137 |
| 1,774,161 | 8/1930 | Wetmore | 432/122 |
| 1,872,210 | 8/1932 | Wunderlich | 432/122 |
| 1,921,956 | 8/1933 | Vickers | 432/122 |
| 2,237,659 | 4/1941 | Edwards | 432/122 X |

*Primary Examiner*—John J. Camby

*Attorney, Agent, or Firm*—Wenderoth, Lind & Ponack

[57] ABSTRACT

A baking method and a kiln to bake many tiles rapidly and continuously which comprises providing endless chains, set fire-proof L-shaped supporting parts that tiles are inserted into, which are provided with an inserting apparatus that puts tiles to be baked intermittently and nearly horizontally at the front end and a rotating loop belt, to receive baked tiles, covered by a wall for keeping them hot at the rear end, and, rotating said chains in and beside the kiln and passing tiles to be baked with holding them in a standing position through the kiln.

3 Claims, 8 Drawing Figures

BAKING METHOD AND KILN FOR TILE

This invention relates to a method and an apparatus for baking tiles or the like. The substance of the invention is, in the process of baking tiles or the like, connecting movable supporting frames or supporting plates, which are made of fire-proof material, with a loop-belt such as an endless chain which is rotated by a driving apparatus, putting tiles or the like to be baked on said supporting frames or supporting plates manually or automatically and letting objects to be baked on tiles or the like pass through the kiln continuously while holding them in a standing position. The invention enables the tiles or the like to be baked rapidly.

Heretofore, the process of baking tiles has been as follows; putting moulded tiles in a saggar manually, piling up these saggars in a kiln-car (wagon for baking) manually and, after baking, taking down these saggars from the kiln-car manually. The tiles are taken from the saggars one by one, so it takes a very long time for the manual labor, which is quite hard. This process is accompanied by low efficiency and high labor cost and has been one of the reasons arresting development of industries of this kind.

The invention eliminates said defects and relates to a method which is intended to bake excellent tiles or the like rapidly and efficiently without hard labor, and to a kiln which is used to realize the method. Other objects and advantages of the invention will be apparent from the following description taken in conjunction with the accompanying drawings wherein:

All the figures illustrate one example of the invention;

Figure 1:
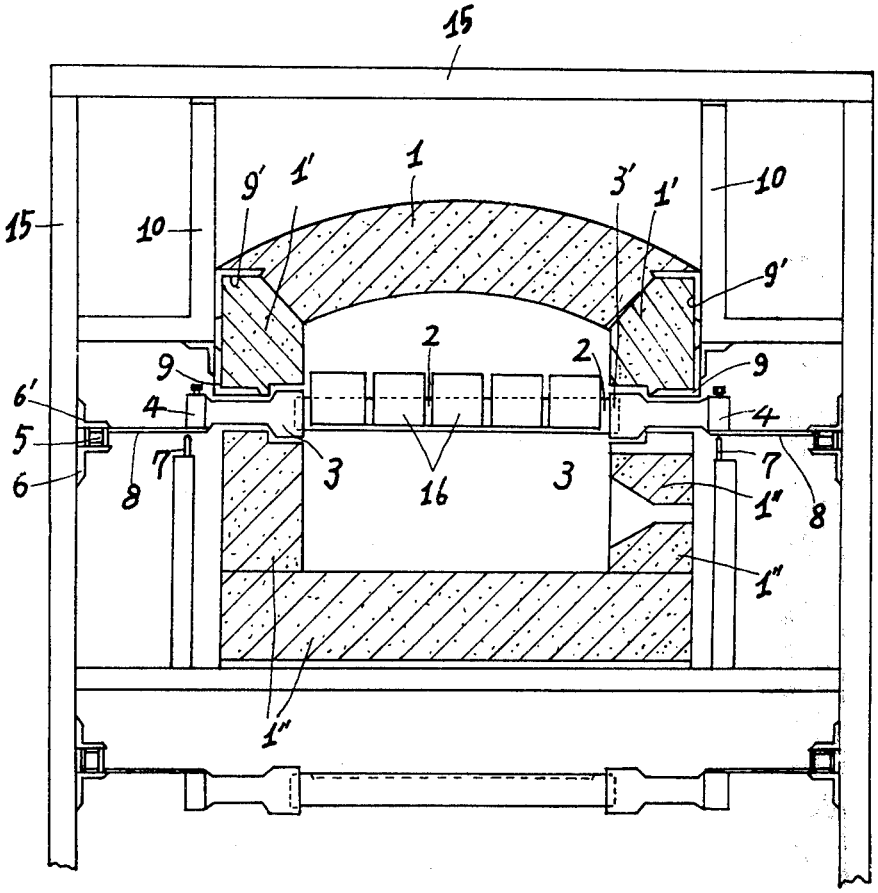
FIG. 1 is a cross section of a kiln which is used to execute the invention.
Figure 2:
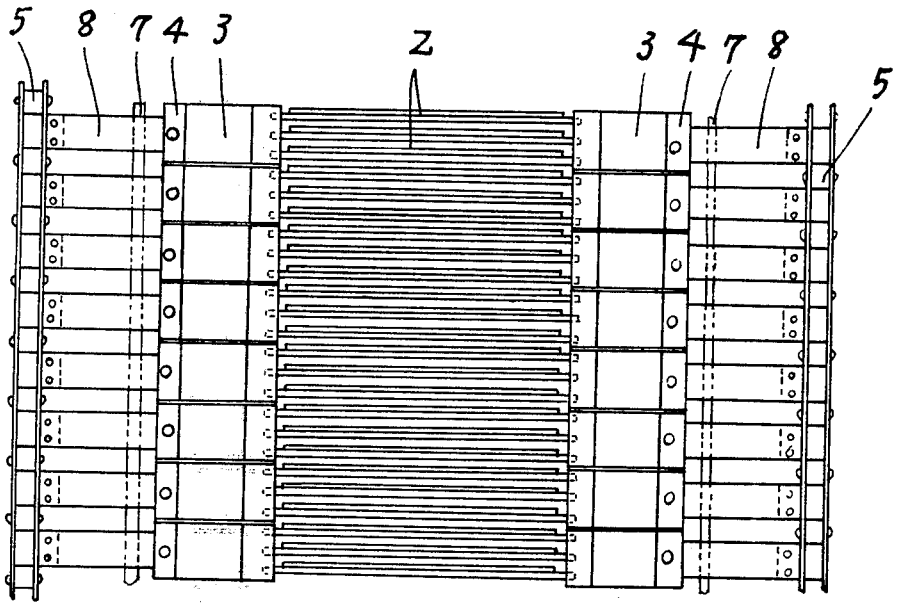
FIG. 2 is a plane figure illustrating the relation between the endless chains and holders of the supporting frames for tiles.

In FIG. 1, the walls of the kiln 1, 1′ and 1″ are made of fireproof and heat insulating material, and as shown in the figure, they are constructed like a so-called tunnel-kiln. The upper parts of the walls of the kiln 1 and 1′ are respectively lifted by fixing frame boards 9, 9′ and 10, which are made of steel, fixed externally with the aid of a lifting frame 15 laid over the kiln, and form a reasonably wide space between the upper part of the wall 1′ and its lower part 1″. In said space between the walls 1′ and 1″, in order to fit and hold both ends of the fireproof supporting frames or supporting plates 2, movable fire-proof holders 3 are set parallel movably, whose number is correlative with that of the supporting frames or supporting plates 2. The outer end of said holder 3 is fixed, as it is or reduced in thickness, to the inner end of a connecting plate 8 with a metal frame or the like 4, which envelopes the holder 3. The holders 3 are supported by suitable supporting equipment 7 located under them without preventing their movement, and beside the kiln holders 3 are connected with a loop belt such as an endless chain 5 that is set in between guide rails 6 and 6′ and rotated continuously or intermittently by an arbitrary driving apparatus. If it is desired, before entering the kiln, a suitable feeding apparatus can be provided which will push, intermittently, the tiles or the like 16 to be baked into the supporting part of said supporting frames or the like 2 through another conveyor or the like, synchronizing with the driving apparatus or not sychronizing. At the exit of and beneath the kiln, a circulating belt 17 is provided which is made up of net or the like for receiving and removing the baked tiles. Spaced away and surrounding said circulating belt 17, a covering wall 18 for keeping baked tiles hot is provided which may be integrated with the wall of the kiln or constructed separately from it and which has holes or the like 19 letting moisture escape.

The invention is the baking method, which rapidly bakes objects such as tiles at a relatively high temperature while they are held in a standing position and pass through the above-mentioned kiln and its apparatus.

Figure 3:
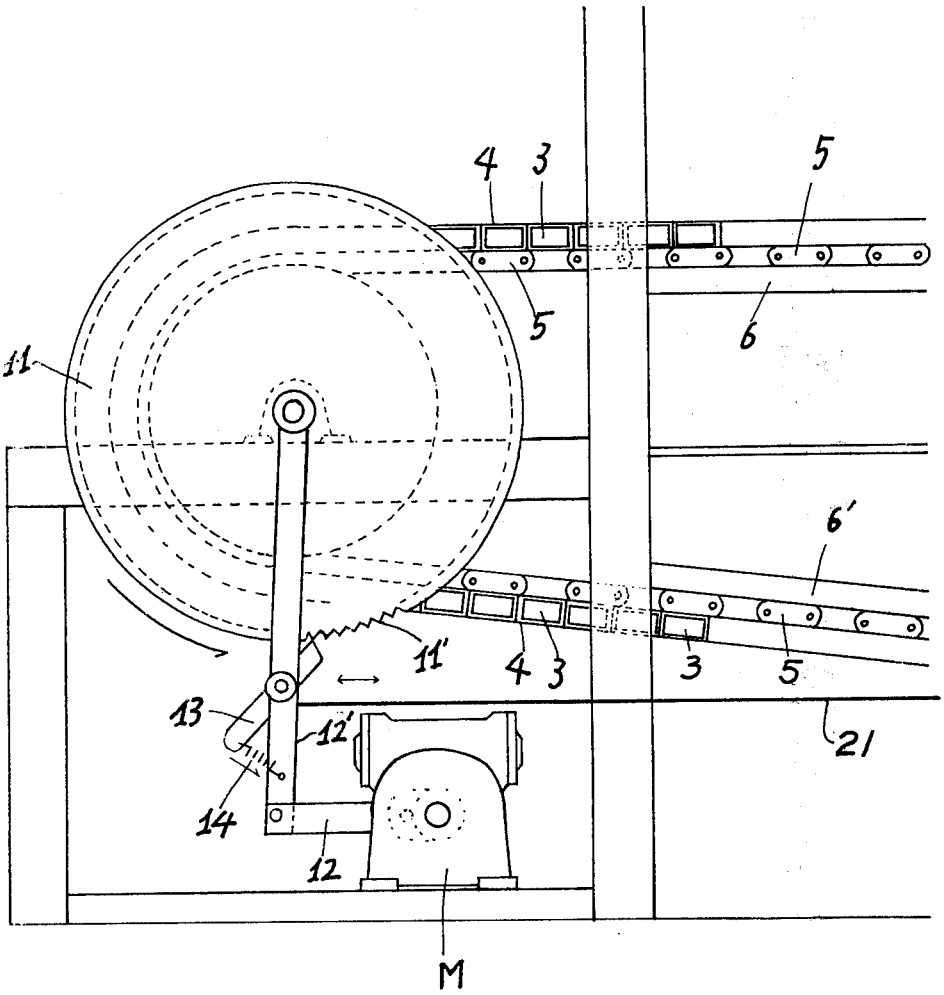
FIG. 3 is a side view of the driving apparatus.
Figure 4:
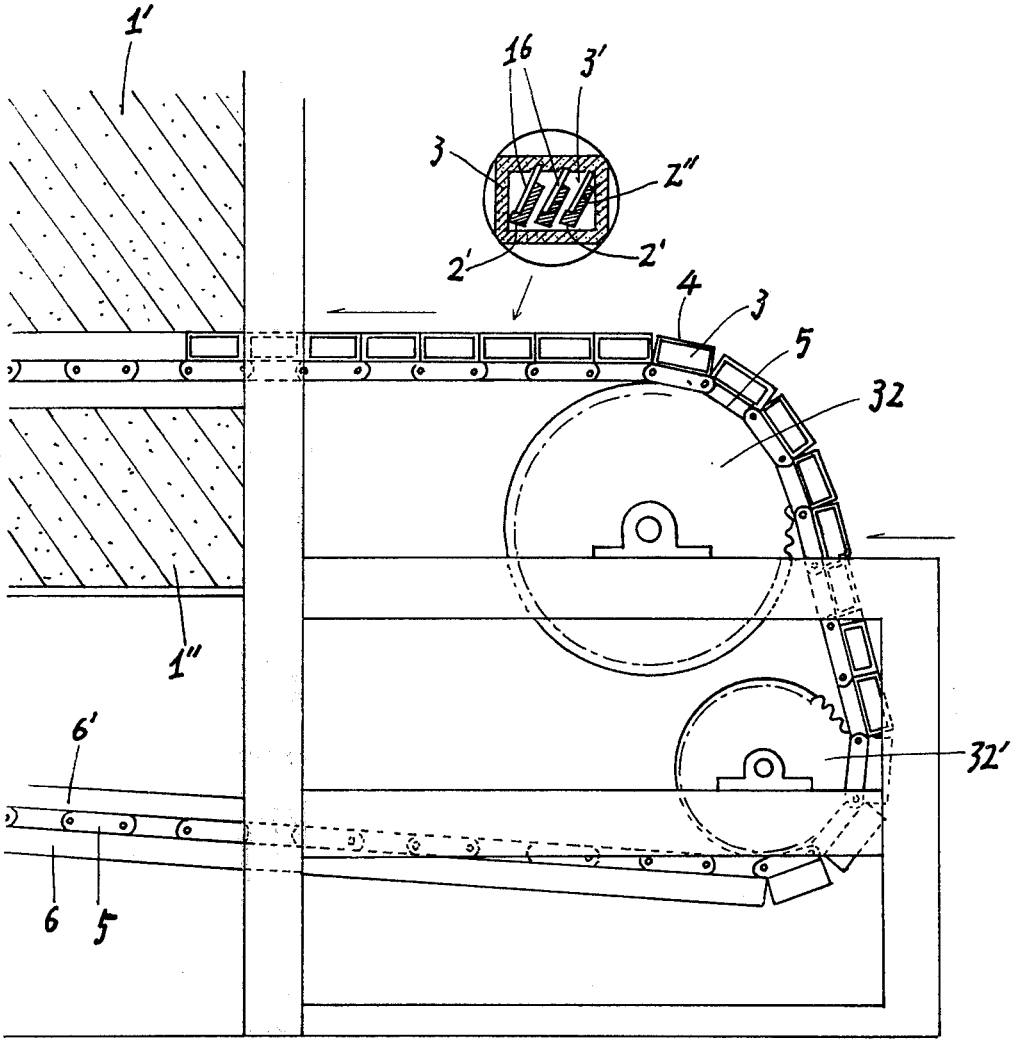
FIG. 4 is a side view illustrating the relation among the endless chain, the holders and the supporting parts.
Figure 6:
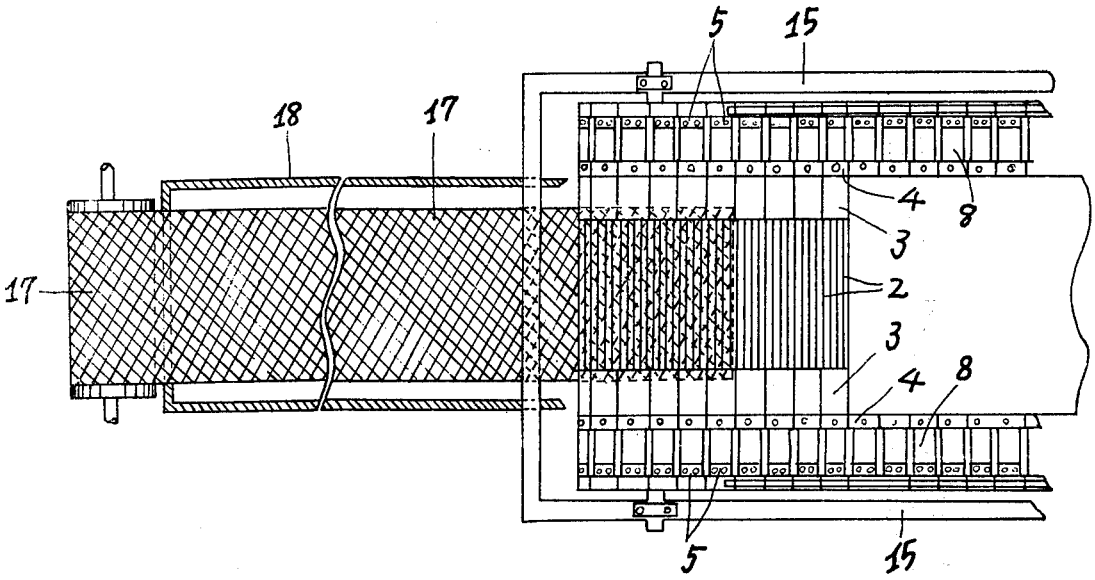
FIG. 6 is a plane figure of the rear part of the kiln and apparatus for carrying out tiles.
Figure 5:
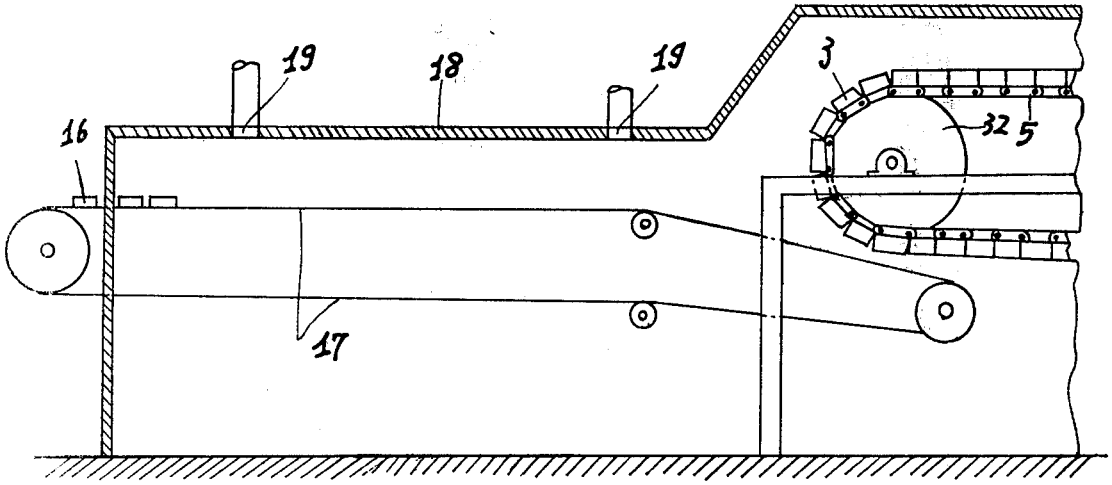
FIG. 5 is a side view of the rear part of the kiln and apparatus for carrying out tiles.
Figure 7:
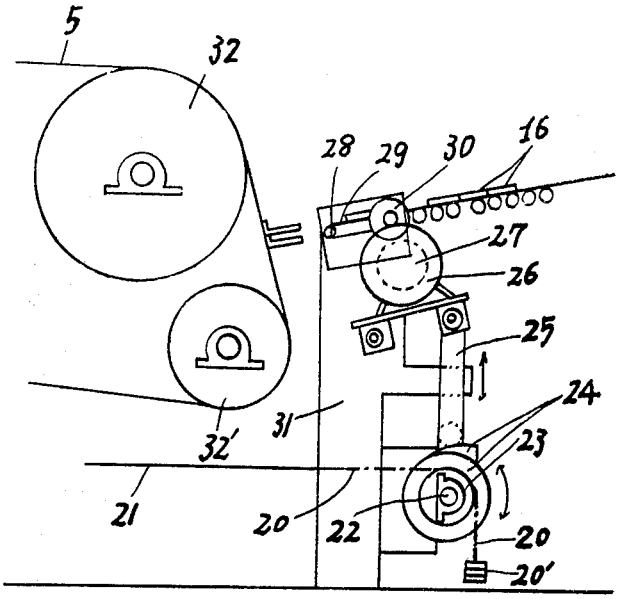
FIG. 7 is a side view of tile feeding apparatus.
Figure 8:
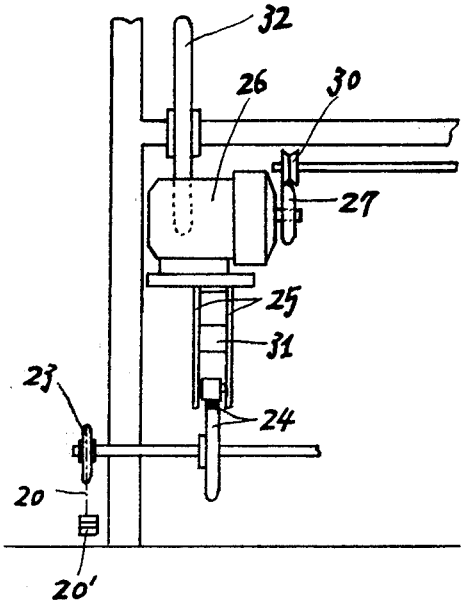
FIG. 8 is a front view of the tile feeding apparatus.

In order to drive the loop belt such as the endless chain or the like 5 by which the supporting parts of the supporting frames or the supporting plates 2 are rotated, a motive wheel 11 behind the kiln with sprockets (not illustrated) located at suitable places is used. Crank shafts 12 and 12′ are connected to the eccentric axis or the cam of a motor M, and, at the middle part of the upper shaft 12′, sending nail 13 is rotatably set and has a downward moment caused by its own weight or a spring 14. The upper edge of the sending nail 13 hooks the teeth 11′ of the motive wheel 11 and with the action of the crank shafts 12 and 12′ the sending nail 13 makes the motive wheel 11 rotate. A synchronization mechanism is provided which rotates the axis 22 of a chain wheel 23 located in front of and beneath the kiln, at the moment when said shaft 12 is pushed backward (refering to FIG. 3, pushed to left), by means of a traction rope 21 connected to said shaft 12 and a chain 20. The axis or the wheel of a geared motor 26, located on a moving rod 25 pushed up by a cam 24 attached to said axis 22, contacts a roller 28 which feeds tiles or the like to the supporting frames or, alternately, a wheel 30 of a conveyor belt 29. With this contact feeding roller 28 or the conveyor belt 29 rotates, and the tiles or the like 16 stopped on the front guide roller and waiting to transfer to the supporting frames are inserted synchronously into the open end of the supporting frames. In FIG. 7, a weight 20′, a framework and guide wheels 32 and 32′ are also illustrated.

The apparatus of the invention used to execute the above-mentioned method for the kiln baking of objects in a standing position is composed like the above explanation. When the apparatus is used, the feeding apparatus for feeding the tiles or the like is positioned at the front end of the kiln and said feeding apparatus is operated synchronously with the driving apparatus such as the chain or the like. It is possible to insert tiles or the like automatically and continuously or intermittently into the supporting part of the fire-proof supporting frames or the like 2 which are fixed horizontally to said chain or the like however, is also possible to insert them manually without the feeding apparatus. If many baking objects and to be inserted into the support frames, automatic insertion is desirable. Automatic insertion however, is not always necessary, especially if there are only a few items to be baked. The objects to be baked are quickly moved to and inserted into the supporting part that comes to the front end of the kiln and has a horizontal position, corresponding with the movement of all the mechanisms. Said supporting part consists of a bottom 2′, which supports the base of the baking object such as tiles or the like 16, and a reasonably long back side 2″; in other words, the cross section is L-shaped. Both ends of one or more supporting parts are fixed in setting spaces 3′ of the fire-proof holders 3 respectively. If a holder has only one supporting part, the baking object is moved, as if dipped up, and held in a standing position by the bottom 2′ and the back side 2″. If plural supporting parts are provided, the tiles or the like are inserted into the spaces between the back side 2″ when they have a horizontal position, and they are supported between the front surface of one back side and the back surface of the next. Then, as the chain or the like 5 rotates, the supporting part goes up, and the position of tiles or the like becomes nearly vertical. After that, keeping the standing position, they go forward into the kiln. As many tiles or the like 16 may be set in a line or in lines in supporting parts of supporting frames or the like 2 with relatively narrow width, and the holders have few sections in the supporting part respectively, the invention has an advantage that it is possible to bake a great number of tiles or the like 16 in a unit area. The kiln baking objects in a standing position in the invention are generally 4–6 m wide, the moving velocity of the endless chain or the like 5 in the kiln is about 65 mm/min; and the proper range of the maximum baking temperature is about 1200°C. The kiln of the invention is provided with a feeding apparatus for feeding the objects to be baked located in front of the kiln and a receiving apparatus for receiving the baked objects at the end of the kiln. The total length of the kiln, including these apparatuses, is 25–30 m. The temperature at said apparatuses is 500°–600°C, and by keeping said high temperature only at the central part of the kiln, the objects set in a standing position are baked rapidly with said velocity. In this method, liquiefied petroleum gas can be used as the heat source, and so the baking cost will be quite economical. When the direct flame baking method is adoptable, the invention has a merit in that it is possible to use a glaze whose melting point is near SK2 and to expect excellent glazing. Therefore, by using the baking method of the invention and by making use of the kiln of the invention, a great number of baked objects, excellently glazed, can be produced in a short time. As a result, with this invention excellent baking can be achieved with increased productivity of 3–5 times, at least, when compared with that of the most improved and productive kiln ever used.

Moreover, if baked objects are received and removed from the kiln on the circulating belt 17 such as mesh belt surrounded by said covering wall 18 which is provided behind the kiln of the invention for keeping the baked objects hot, the surface of the baked objects cools gradually by convection, and the remaining heat is used to preheat the kiln as the auxiliary heat source. So, the invention has the advantage of improving the thermal efficiency of the total system, and a utility in that fuel cost can be reduced very much.

When the automatic feeding apparatus for feeding the objects to be baked is used to execute the invention, the tiles or the like can be inserted automatically and synchronously into the supporting parts of the supporting frames or the like, and the invention will have the additional advantage in that working hours can be reduced remarkably, and the tiles or the like are inserted correctly and rapidly into the supporting parts set on the loop belt such as an endless chain or the like.

I claim as my invention:

1. A method for baking tiles or the like in a baking apparatus which bakes the tiles in an upright position, said baking apparatus having:

a tunnel kiln, an endless chain through the tunnel kiln which has L-shaped supporting receptacles attached thereto for supporting the items to be baked in an upright position as they pass through the kiln on the endless chain, said chain being supported and moved by gear wheels at the entrance of the kiln, and by sprockets at the exit from the kiln moved by a motive wheel, and a feeding means at the entrance to the kiln with an inclined feeding conveyor which conveys the items to be baked into the L-shaped receptacles, said method comprising:

intermittently rotating the motive wheel by driving means positioned outside the kiln, thereby causing the endless chain to move intermittently;

intermittently conveying and loading the items to be baked onto the long back portion of the L-shaped receptacles on the endless chain by the intermittent rotation of the feeding conveyor in response to the intermittent rotation and stopping of the endless chain at the front of the kiln;

passing the items to be baked through the kiln in an upright position at a speed of approximately 4 meters per hour.

2. In a baking apparatus for baking tiles or the like in an upright position, said baking apparatus having a tunnel kiln, and an endless chain through the tunnel kiln which has L-shaped supporting receptacles attached thereto for supporting the items to be baked in an upright position as they pass through the kiln on the endless chain, the improvements comprising:

rotating means for rotating said endless chain through the kiln, said rotating means comprised of:

a notched wheel operatively connected to said endless chain at the exit from the kiln, a motor having an eccentric axis positioned at the exit from and beneath said kiln, crank shaft means connected at one end to said motor for movement therewith, and a sending nail rotatably attached at middle portion thereof to said crank shaft means, the lower portion of said nail having a continuous downward moment and the upper portion of said nail being engageable with said notched wheel, whereby in response to the rotation of the motor, the crank shaft moves and causes the sending nail engaged with said notched wheel to rotate said wheel, thereby causing said endless chain to rotate;

feeding means at the entrance of the kiln for feeding the items to be baked into the support receptacles of the endless chains, said feeding means comprised of:

inclined conveyor means spaced from the support receptacles at the entrance of the kiln for conveying the items to be baked in the kiln into the support receptacles, roller means operatively attached to said conveyor means for turning said conveyor means, and feed motor means pivotally mounted beneath said conveyor means and said roller means for pivoting, contacting, and rotating said roller means, whereby said conveyor means turns and feeds the items to be baked into the support receptacles; and synchronizing means connected between the rotating means and the feeding means for synchronizing the feeding of the items to be baked with the intermittent motion of the endless belt, said synchronizing means comprised of:

an axially mounted chain wheel beneath and at the front of the kiln under the feed motor means, a traction rope attached at one end to said crank shaft means, a chain attached to the free end of said traction rope and fitted partially around the circumference of said chain wheel, a weight attached to the free end of said chain fitted around said chain wheel, a cam coaxially mounted with said chain wheel for rotation as the chain wheel rotates, a moving rod resting against the circumference of said cam at one end and attached to said feed motor means at the other end, whereby movement of the crank shaft causing the intermittent movement of the endless chain causes the traction rope and chain attached thereto to move in the direction of the crank shaft, thus causing the chain wheel and its coaxially mounted cam to rotate against the moving rod and pivot the feed motor means attached thereto upward against the roller means, thereby turning the conveyor means and feeding the items to be baked into the support receptacles on the endless chain.

3. An improved baking apparatus as claimed in claim 2 further comprising a spring attached to said crank shaft means at one end and to the lower portion of said sending nail at the other end for imparting the continuous downward moment to the lower portion of the sending nail.

* * * * *